US009510992B2

(12) United States Patent
Fu et al.

(10) Patent No.: US 9,510,992 B2
(45) Date of Patent: Dec. 6, 2016

(54) REHABILITATION DEVICE WITH PACE PATTERN PROJECTING FUNCTION AND SEAT STRUCTURE AND CONTROL METHOD THEREOF

(71) Applicant: National Taiwan University, Taipei (TW)

(72) Inventors: Li-Chen Fu, Taipei (TW); Cheng-Hsien Lin, Taipei (TW); Chung-Dial Lim, Taipei (TW); Chia-Ming Wang, Taipei (TW); Shih-Huang Tseng, Taipei (TW)

(73) Assignee: National Taiwan University, Taipei (TW)

( * ) Notice: Subject to any disclaimer, the term of this patent is extended or adjusted under 35 U.S.C. 154(b) by 26 days.

(21) Appl. No.: 14/555,694

(22) Filed: Nov. 28, 2014

(65) Prior Publication Data

US 2016/0058649 A1 Mar. 3, 2016

(30) Foreign Application Priority Data

Sep. 1, 2014 (TW) ..... 103130124 A

(51) Int. Cl.
*A63B 24/00* (2006.01)
*A61H 3/04* (2006.01)

(52) U.S. Cl.
CPC ..... *A61H 3/04* (2013.01); *A63B 24/0062* (2013.01); *A63B 2024/0068* (2013.01)

(58) Field of Classification Search
CPC ..... A63B 24/00; A63B 24/0062; A63B 2024/0068; A63B 2024/068; A61H 3/04; A61H 3/00; A61B 5/1113; A61B 5/1038
See application file for complete search history.

(56) References Cited

U.S. PATENT DOCUMENTS 6,743,156 B1 6/2004 Jacques, II et al.
7,484,740 B2 * 2/2009 Miller ..... A61H 3/04 135/65

(Continued)

FOREIGN PATENT DOCUMENTS

CN 103110488 5/2013
CN 103126858 6/2013

(Continued)

OTHER PUBLICATIONS

Wei-Hao Mou, "Context-Aware Interactive Walking-Aid Robotic Walker," Master Thesis, Jul. 2012, Graduate Institute of Computer (Continued)

*Primary Examiner* — Glenn Richman
(74) *Attorney, Agent, or Firm* — Jianq Chyun IP Office

(57) ABSTRACT

A rehabilitation device with pace pattern projecting function and seat structure and a control method thereof are provided. The rehabilitation device includes a body with a moving module, a projection device, a first sensor and a control system. The projection device projects pace patterns on a walking plane. The first sensor detects a walking situation of a user on the walking plane. Based on the walking situation detected by the first sensor, the control system adjusts a distance between the rehabilitation device and the user by controlling the moving module and adjusts a position of the pace patterns on the walking plane by controlling the projection device. Moreover, a movable seat mechanism is also disposed on the rear of the rehabilitation device. The user can sit down on the movable seat mechanism and towards the front of the rehabilitation device to rest moderately.

13 Claims, 9 Drawing Sheets

(56) References Cited

U.S. PATENT DOCUMENTS

| | | | | |
|---|---|---|---|---|
| 7,826,983 | B2 * | 11/2010 | Alwan | A61B 5/1038 702/33 |
| 8,500,143 | B2 | 8/2013 | Yu et al. | |
| 8,718,748 | B2 * | 5/2014 | Reinhold | A61B 5/1113 600/407 |
| 8,965,063 | B2 * | 2/2015 | Hanna | G06K 9/00604 382/100 |
| 9,084,712 | B2 * | 7/2015 | Roerdink | A61H 3/00 |

FOREIGN PATENT DOCUMENTS

| | | |
|---|---|---|
| TW | I364277 | 5/2012 |
| TW | 201422221 | 6/2014 |
| WO | 2013002452 | 1/2013 |

OTHER PUBLICATIONS

Science and Information Engineering, College of Electrical Engineering and Computer Science, National Taiwan University.

Chung-Dial Lim, "Sensory Cues Guided Rehabilitation Robotic Walker Realized by Depth Image based Gait Analysis," Master Thesis, Jul. 2014, Department of Computer Science and Information Engineering, College of Electrical Engineering and Computer Science, National Taiwan University.

"Office Action of Taiwan Counterpart Application" , issued on Dec. 14, 2015, p. 1-p. 3, in which the listed references were cited.

* cited by examiner

REHABILITATION DEVICE WITH PACE PATTERN PROJECTING FUNCTION AND SEAT STRUCTURE AND CONTROL METHOD THEREOF

CROSS-REFERENCE TO RELATED APPLICATION

This application claims the priority benefit of Taiwan application serial no. 103130124, filed on Sep. 1, 2014. The entirety of the above-mentioned patent application is hereby incorporated by reference herein and made a part of this specification.

BACKGROUND OF THE INVENTION

Field of the Invention

The invention relates to a medical device and a technique for rehabilitation and training, and more particularly, relates to a rehabilitation device with a pace pattern projecting function for assisting users to walk and seat structure, and a control method thereof.

Description of Related Art

Nowadays, social structure is gradually trending to aging population. Accordingly, various medical devices have been developed gradually in directions such as usages for elderly people, muscle training, limb rehabilitation, and so on. For patients with Parkinson disease, problems with mobility often occur in everyday life, and thus a movable assistive device is required to assist in walking or moving. The conventional movable assistive devices (e.g., a crutch and a walking-aid) require force by a user to move the movable assistive devices before they can assist the user to move forward. In addition, aforementioned movable assistive devices are all in form of passive operation, which means that the user needs to spend considerable efforts in order to operate the movable assistive devices. Moreover, the user is prone to risks of unpredictable danger if reaction of the user is not sensitive enough. Further, in case of unusual circumstances (e.g., the user is exhausted), the passive movable assistive devices is incapable of providing active assistances for the user, such that the movable assistive devices may fail to achieve expected goals in terms of walking-aid or rehabilitation.

On the other hand, while using a rehabilitation device, the user often needs to use different parts of the rehabilitation device for different rehabilitation exercises. The user needs to spend extra efforts on learning methods for using the rehabilitation device, which results in waste of time and efforts. Accordingly, researchers and manufactures of the medical devices are looking forward to enhance functionality of the movable assistive devices which allows the user to achieve the expected effects during rehabilitation process.

SUMMARY OF THE INVENTION

The invention is directed to a rehabilitation device with pace pattern projecting function and seat structure, and a control method thereof. The rehabilitation device controls a projection device to project pace patterns on a moving direction of a user in order to assist and guide the user to move forward through the pace patterns. The rehabilitation device is also capable of properly adjusting distances from the user to the rehabilitation device and the pace patterns based on a walking situation of the user, so that the user is able to achieve expected effects during a process of using the rehabilitation device. In addition, the rehabilitation device also includes a movable seat member, in which seat structures may be unfolded for the user required rest to sit down towards the front of the rehabilitation device to rest moderately.

The invention provides a rehabilitation device. The rehabilitation device includes a body, a projection device, a first sensor and a control system. The body has a moving module. The projection device is disposed on the body, and configured to project pace patterns on a walking plane. The first sensor is disposed on the body and towards an opposite direction of a predetermined motion direction of the body. The first sensor detects a walking situation of a user on the walking plane. The control system is disposed on the body. The control system is connected to the projection device and the first sensor. Based on the walking situation detected by the first sensor, the control system adjusts a distance between the rehabilitation device and the user by controlling the moving module and adjusts a position of the pace patterns on the walking plane by controlling the projection device.

In an embodiment of the invention, the body further includes a movable seat member. The movable seat member is disposed on brackets above rear wheels at two sides of the body. The movable seat member includes two seat structures opposite to each other. Each of the seat structures includes a seat portion, a movable shaft mechanism and a support portion. The seat portion has a seat surface and a second surface opposite to the seat surface. The movable shaft mechanism is connected to the seat portion to enable the seat portion to be unfolded or folded with respect to the body. The support portion is connected to the second surface of the seat portion. The support portion is configured to support the seat portion by bending the support portion to contact the ground when the seat portion is unfolded by the movable shaft mechanism.

From another aspect, the invention further provides a control method of a rehabilitation device. The rehabilitation device includes a projection device and a first sensor. The control method includes the following steps. At least one pace pattern is projected on a walking plane by the projection device. A walking situation of a user on the walking plane is detected by the first sensor. Further, based on the walking situation, a distance between the rehabilitation device and the user is adjusted by controlling a moving module and a position of the pace patterns on the walking plane is adjusted by controlling the projection device.

Based on the above, the rehabilitation device according to the embodiment of the invention controls the projection device to project the pace pattern on the moving direction of the user and detects the walking situation of the user in order to adaptively adjust the distance between the pace pattern and the user or adjust the distance between the rehabilitation device and the user. Accordingly, the rehabilitation device is capable of providing additional visual guide to the user through projection of the pace patterns to assist the user in the walking exercises, so that the user may achieve the expected effects during the rehabilitation process. On the other hand, the rehabilitation device is capable of knowing whether the user is exhausted according to the physiological sensing unit in the handles gripped by the user, so as to prevent the user from not being able to stand due to exhaustion. The pressure sensing unit in the handles allows the user to change the moving direction of the rehabilitation device. The movable seat mechanism is further disposed on the rear of the rehabilitation device for the user to sit down on the movable seat mechanism and towards the front of the rehabilitation device to rest moderately. The movable seat mechanism can be easily folded or unfolded by the user.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
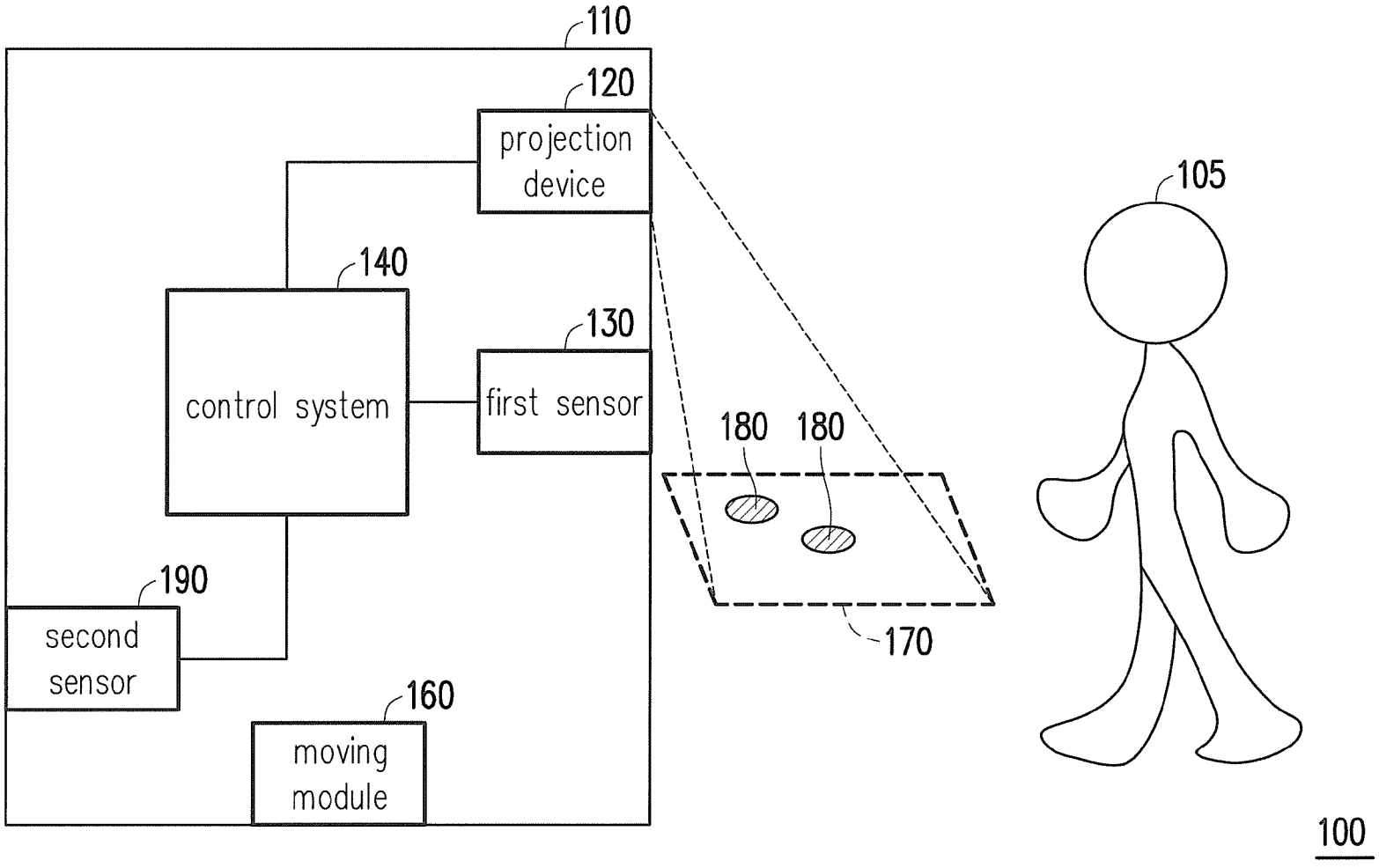
FIG. 1 is a schematic scenario diagram of a rehabilitation device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
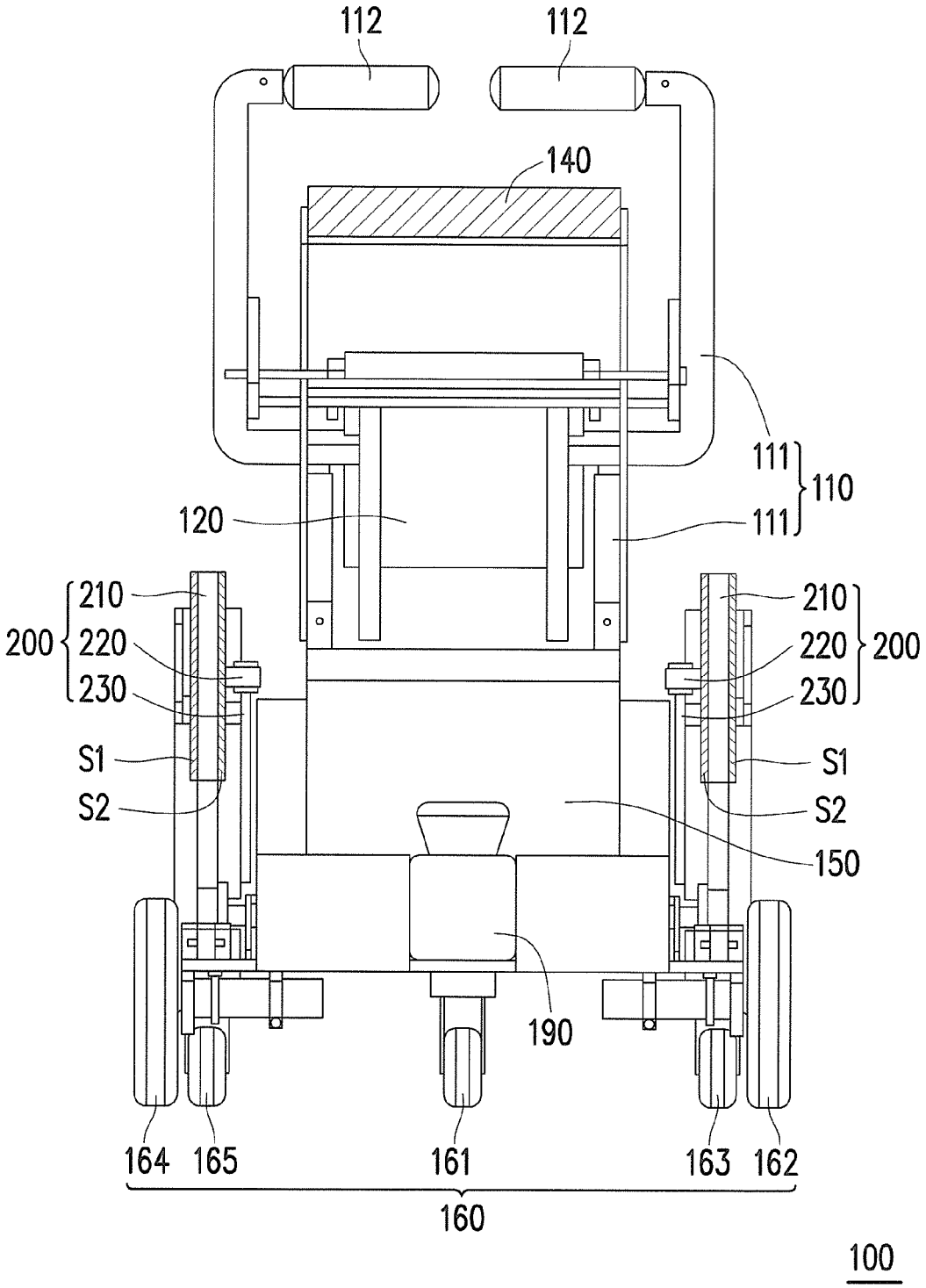
FIG. 2, FIG. 3 and FIG. 4 are structure diagrams of the rehabilitation device according to the embodiment of the invention.
Figure 3:
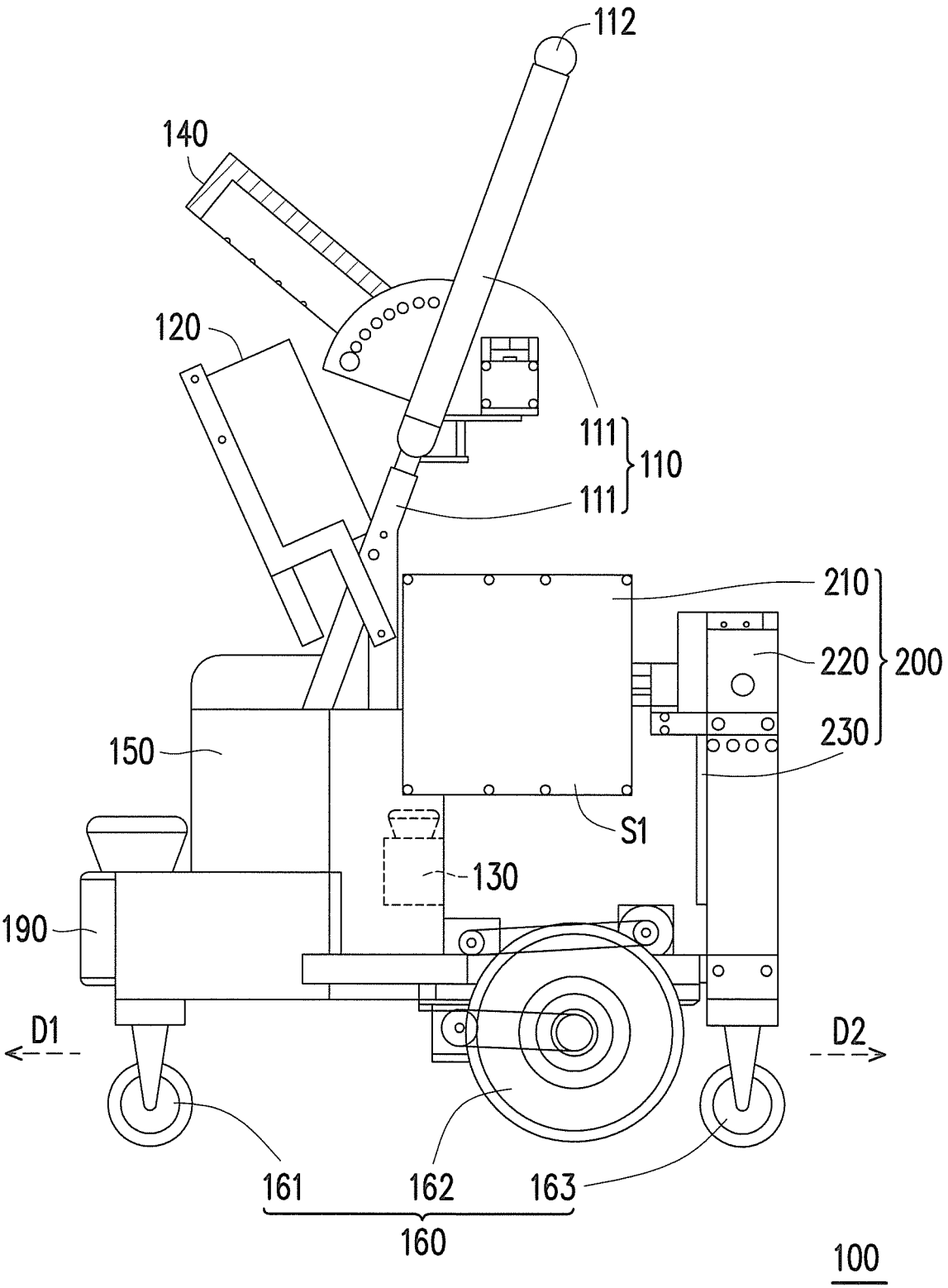
Figure 4:
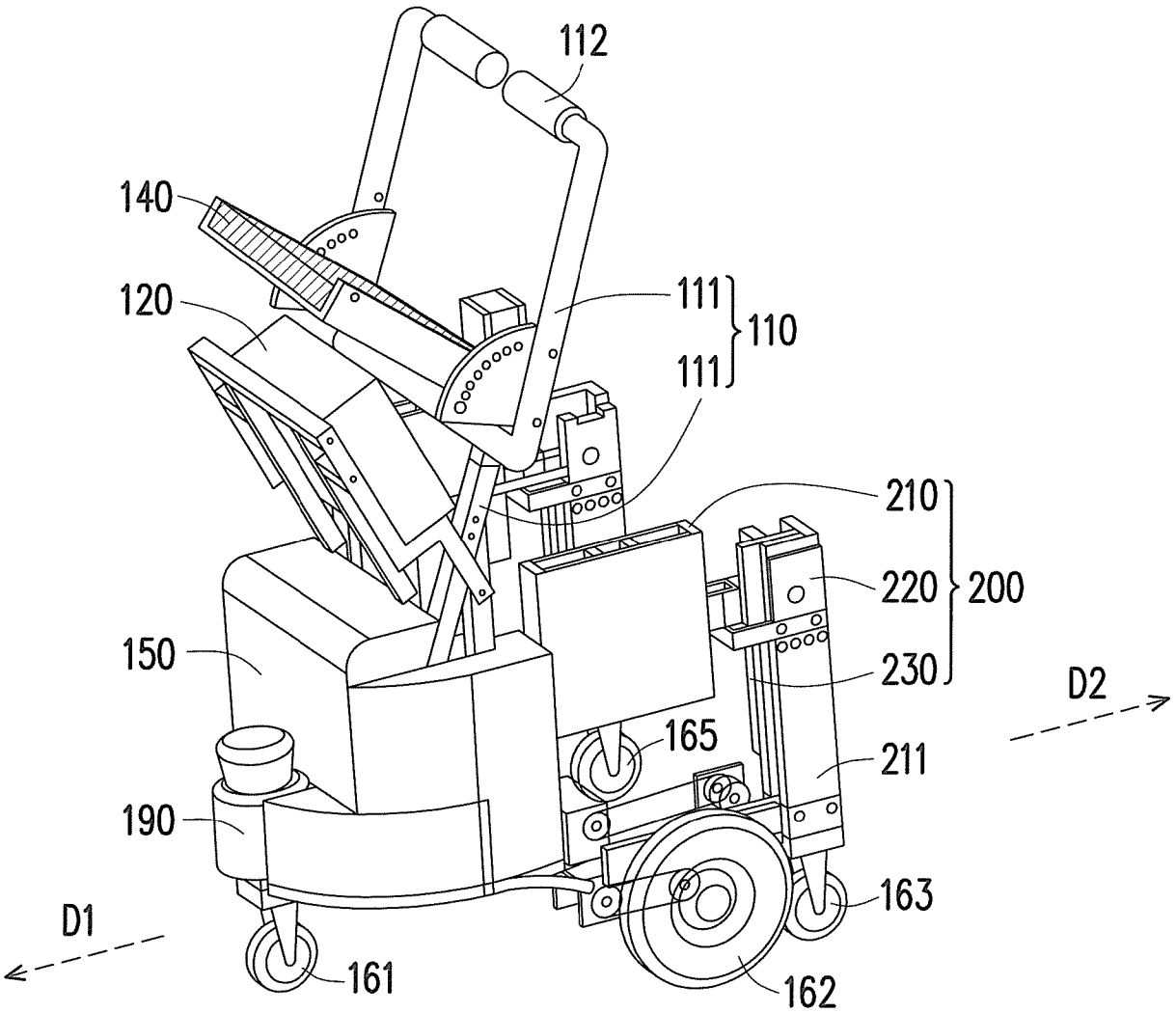

FIG. 1 is a schematic situation diagram of a rehabilitation device 100 according to an embodiment of the invention. FIG. 2, FIG. 3 and FIG. 4 are structure diagrams of the rehabilitation device 100 according to the embodiment of the invention. More specifically, FIG. 2, FIG. 3 and FIG. 4 are respectively a front view, a side view and an isometric view of the rehabilitation device 100 according to the embodiment of the invention. Referring to FIG. 1 to FIG. 4 together, the rehabilitation device 100 is a medical device mainly used for assisting a patient with foot injury to conduct a rehabilitation treatment. The rehabilitation device 100 is also suitable for a patient with disease that affects mobility (e.g., Parkinson disease), such that the patient is able to slow down degradation of mobility through lower limb exercises. Furthermore, the rehabilitation device 100 according to the embodiment of the invention is also suitable for a child who is learning to walk as well as a general user. Accordingly, persons who applying the present embodiment may have the rehabilitation device 100 applied to usage for the general, and the invention is not limited to be used for the patents with foot injury or Parkinson disease only.

The rehabilitation device 100 mainly includes a body 110, a projection device 120, a first sensor 130 and a control system 140. The body 110 is composed of a plurality of supporting brackets 111, a gripping member 112, a casing 150 and a moving module 160. The supporting brackets 111 are extended outwardly from the casing 150, and the gripping member 112 (illustrated in FIG. 2 to FIG. 4) is disposed at a curved portion of the supporting brackets 111 being extended upwardly. A user 105 can grip on the gripping member 112 in order to support the user 105, assist the user 105 in lower limb exercises, and allow the user 105 to control a moving direction of the rehabilitation device 100. In the present embodiment, the supporting bracket 111 where the gripping member 112 is located may be configured as an extensible and movable bracket, so that a height of the gripping member 112 may be adjusted according to a height of the user 105. The first sensor 130 and other elements (e.g., a motor, a storage battery, a computer of the control system 140, related circuitry, etc., which are used by the moving module 160) may be covered by the casing 150.

The moving module 160 mainly includes a wheel 161 at the front, wheels 162 to 165 at the two sides, the motor, a power source (e.g., the storage battery) and a transmission mechanism composed of a plurality of elements. In the present embodiment, the motor and the storage battery are disposed inside the casing 150. The wheels 161 to 165 are disposed beneath the body 110, and the wheels 161 to 165 move in a rolling manner for driving the body 110 and the rehabilitation device 100 to move. The user can grip on the gripping member 112 to move together with the rehabilitation device 100. The moving module 160 can receive instructions from the control system 140 to run the motor, so as to drive the wheels 161 to 165 through the transmission mechanism. The control system 140 may also provide signals for controlling the transmission mechanism to move forward, move backward, turn around, stop etc., so that the rehabilitation device 100 can move towards different directions or stop according to the control system 140. The control system 140 may also receive remote control commands from an external device in order to execute the corresponding actions.

The projection device 120 is disposed on one of the supporting brackets 111 of the body 110. The projecting device 120 may be an optical projector capable of projecting one or more pace patterns 180 on a walking plane 170 walked by the user 105 in order to guide the user 105 to move forward. The shape of the pace pattern 180 may be a pattern in a footprint shape, or other patterns that the user 105 is willing to step forward on them. Persons who applying the present embodiment may implement the pace pattern 180 by using any geometric figures or art patterns, and the pattern of the pace pattern 180 is not particularly limited in the invention. In the present embodiment, a projecting lens of the projecting device 120 is disposed towards an opposite direction D2 of a predetermined motion direction D1 of the rehabilitation device 100 and disposed on the walking plane 170 in an oblique angle from the above, so that the pace pattern 180 can be projected on the walking plane 170.

The first sensor 130 of the present embodiment is disposed inside the casing 150 of the body 110, and disposed towards the opposite direction D2 of the predetermined motion direction D1, so as to detect a walking situation of the user 105. The first sensor 130 may also be disposed outside the casing 150, and whether the first sensor 130 is disposed inside or outside the casing 150 is not particularly limited in the present embodiment, as long as the first sensor 130 is disposed towards the opposite direction D2 and capable of detecting the walking situation of the user. In the present embodiment, the first sensor 130 may be, for example, an image capturing device of a camcorder. By receiving the image captured on the walking plane 170 by the first sensor 130 (the image capturing device) and detecting and estimating a feet position of the user 105 by an image processing and discrimination program, the control system 140 continuously detects the feet position in order to obtain the walking situation of the user 105. In the present embodiment, the walking situation of the user 105 includes one or any combination of the following messages: a spacing distance between the user 105 and the rehabilitation device 100, a stride length per step of the user 105, a gait speed of the user 105, two foot positions of the user 105 and/or a foot reaction time of the user 105 to the pace pattern 180. The invention is not limited to above disclosed messages, and instead, persons who applying the present embodiment may also use the image of the feet position of the user 105 to obtain other walking situations regarding the user 105.

The control system 140 can determine whether the walking situation of the user 105 matches a preset rehabilitation standard, so as to adaptively adjust a distance between the rehabilitation device 100 and the user 105 by the moving module 160 and adaptively adjust a distance from the pace pattern 180 to the user 105 in order to achieve expected effects from the rehabilitation process. Specifically, one or more types of the preset rehabilitation standard message are already included in the control system 140 of the rehabilitation device 100. The user 105 and medical personnel or assisting personnel nearby may select a proper rehabilitation standard by using the control system 140, so that the user 105 may perform the lower limb exercises in the rehabilitation process. The control system 140 determines whether the selected preset rehabilitation standard is matched based on the walking situation of the user.

Specifically, when the control system 140 determines that the walking situation of the user matches the selected preset rehabilitation standard, the control system 140 controls the moving module 160 to move the rehabilitation device 100 forward by a preset distance towards the preset motion direction D1 and controls the projection device 120 to project the pace pattern 180 on a proper position away from foot portions of the user 105, so as to guide the user 105 to keep on moving forward. On the other hand, when the control system 140 determines that the walking situation of the user does not match the selected preset rehabilitation standard, the control system 140 controls the projection device 120 to adjust a position of the pace pattern 180 projected on the walking plane 170 based on the walking situation of the user, so as to properly adjust a distance between the pace pattern 180 and the user 105 for matching to the walking situation of the user. For instance, when the stride length of the user is less than the current distance between the projected pace pattern 180 and the user 105, the control system 140 needs to reduce the distance between the pace pattern 180 and the user 105, so that the user 105 can step on the pace pattern 180 more easily. When the stride length of the user is not less than the current distance between the projected pace pattern 180 and the user 105, the control system 140 can properly increase the distance between the pace pattern 180 and the user 105 in order to further enhance rehabilitation effects.

It should be noted that, the rehabilitation device 100 according to the embodiment of the invention has a pressure sensing unit and a physiological sensing unit disposed on a surface of the gripping member 112 for monitoring a physiological statistics of the user 105 or a gripping condition of a hand portion of the user 105. Accordingly, the rehabilitation device 100 is capable of automatically stopping or interrupting aforementioned rehabilitation process by reference with the physiological statistics of the user 105, and changing the moving direction of the rehabilitation device 100 according to a force applied by the user 105 on handlers. The pressure sensing unit and the physiological sensing unit are respectively connected to the control system 140 through circuitry inside the supporting brackets 111. The pressure sensing unit is configured to sense a gripping degree of the hand portion of the user with respect to the gripping member 112. The physiological sensing unit is configured to sense a physiological value of the user. In the present embodiment, when the control system 140 uses the pressure sensing unit to detect that the gripping degree with respect to a left handle or a right handle of the gripping member 112 is greater than a preset pressure value, it indicates that the user intends to move the rehabilitation device 100 towards the left side or the right side of the user 105. Accordingly, the control system 140 can turn around the rehabilitation device 100 for automatically changing the moving direction thereof according to the gripping degree with respect to the left handle or the right handle of the gripping member 112, so as to prevent the user 105 from taking the effort of adjusting the moving direction manually. On the other hand, when the control system 140 uses the physiological sensing unit (e.g., a heartbeat sensor) to detect that the physiological value (e.g., heart rate per minute) of the user exceeds a preset physiological value range, it indicates that the user may have difficulties to continue walking exercises due to exhaustion. In this case, the control system 140 can stop moving the rehabilitation device 100 to prevent the user from falling down or prevent other accidents from happening due to exhaustion of the patient. On the other hand, the gripping member 112 of the present embodiment may further include a safety switch, so that the user 105 may instantly switch off the rehabilitation device 100 by using the safety switch in order to avoid accidents.

The rehabilitation device 100 further includes a second sensor 190 (referring to FIG. 2 to FIG. 8). The second sensor 190 is disposed on the body 110 and towards the predetermined motion direction D1 of the body 110. The second sensor 190 is configured to sense whether an object exists in the predetermined motion direction D1 and determine a distance between the object and the rehabilitation device 110, so as to generate an object sensing signal and provide the object sensing signal to the control system 140 for determining whether to stop/interrupt the rehabilitation process. The second sensor 190 of the present embodiment may be implemented by using an environment map sensor. The environment map sensor is configured to detect obstacles near the rehabilitation device 110 and execute an indoor positioning.

Figure 5:
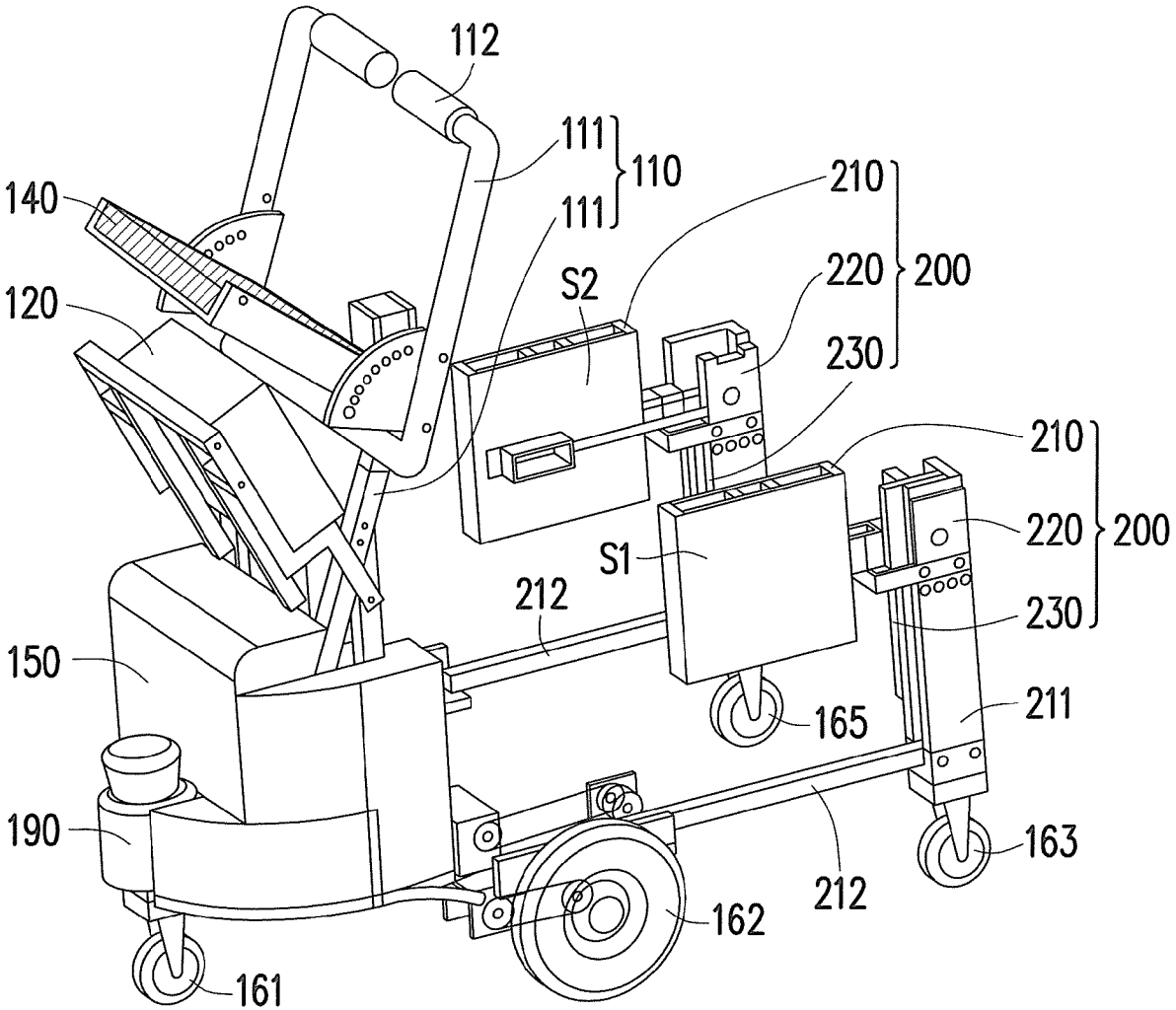
FIG. 5 to FIG. 8 are schematic breakdown views for each operating state of the movable seat member of the rehabilitation device according to the embodiment of the invention.

It should be noted that, the rehabilitation device 100 also includes a movable seat member 200, in which seat structures may be unfolded for the user required rest to sit down towards the front of the rehabilitation device to rest moderately. In other words, when the user 105 needs to rest moderately, the rehabilitation device 100 according to the embodiment of the invention provides the movable seat member 200 for the user 105 to take a short break. The body 110 further includes the movable seat member 200, which is disposed on brackets 211 above the rear wheels 163 and 165 at two sides of the body 110. FIG. 5 to FIG. 8 are schematic breakdown views for each operating state of the movable seat member 200 of the rehabilitation device 100 according to the embodiment of the invention. Referring to FIG. 2 to FIG. 8, when the movable seat member 200 is to be used, the user or accompanying personnel may pull out slidable structures 212 between the casing 150 and the brackets 211 as shown in FIG. 5 for the user 105 to sit down comfortably without hitting other parts such as the casing 150 at the front.

Figure 6:
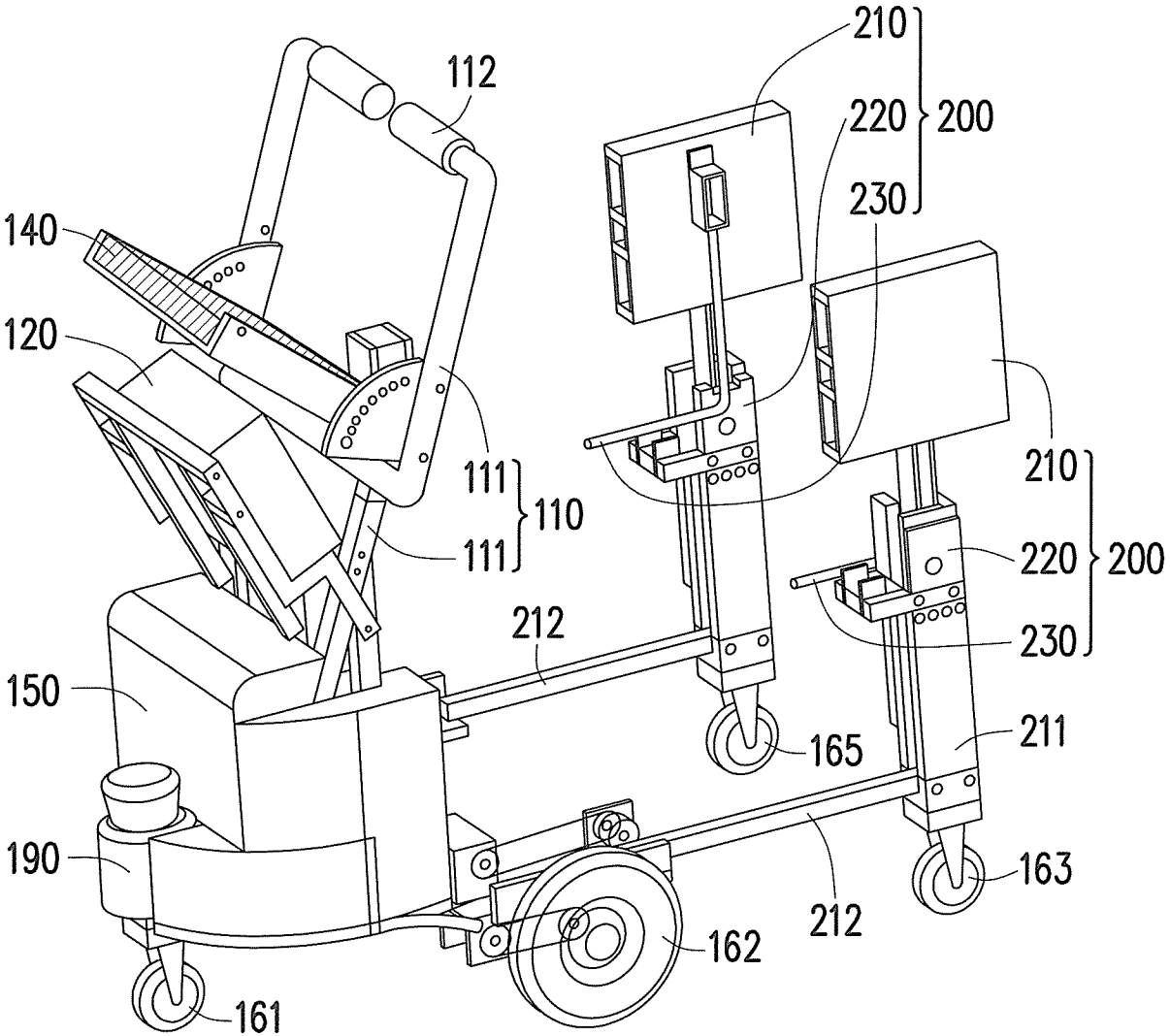
Figure 7:
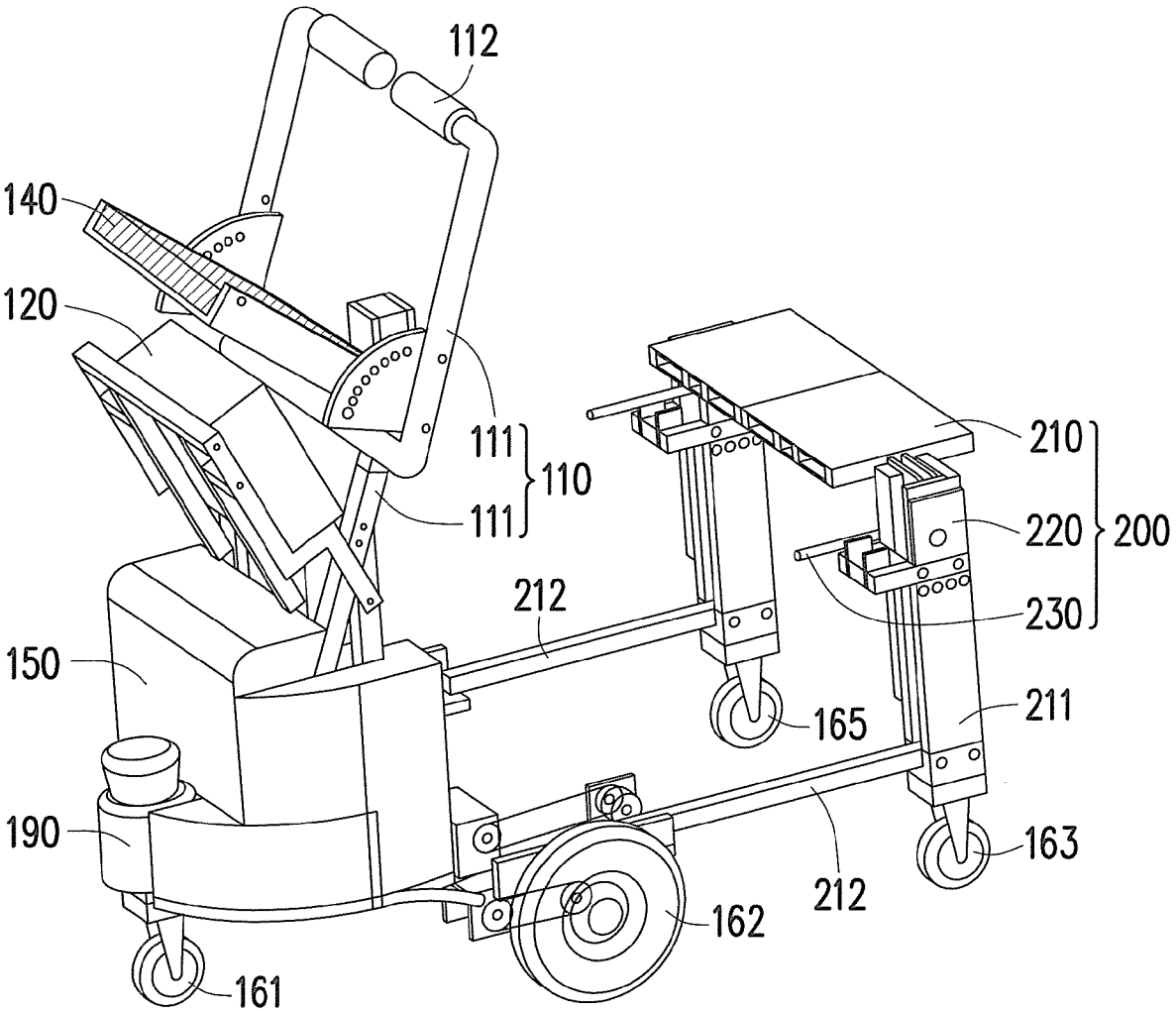
Figure 8:
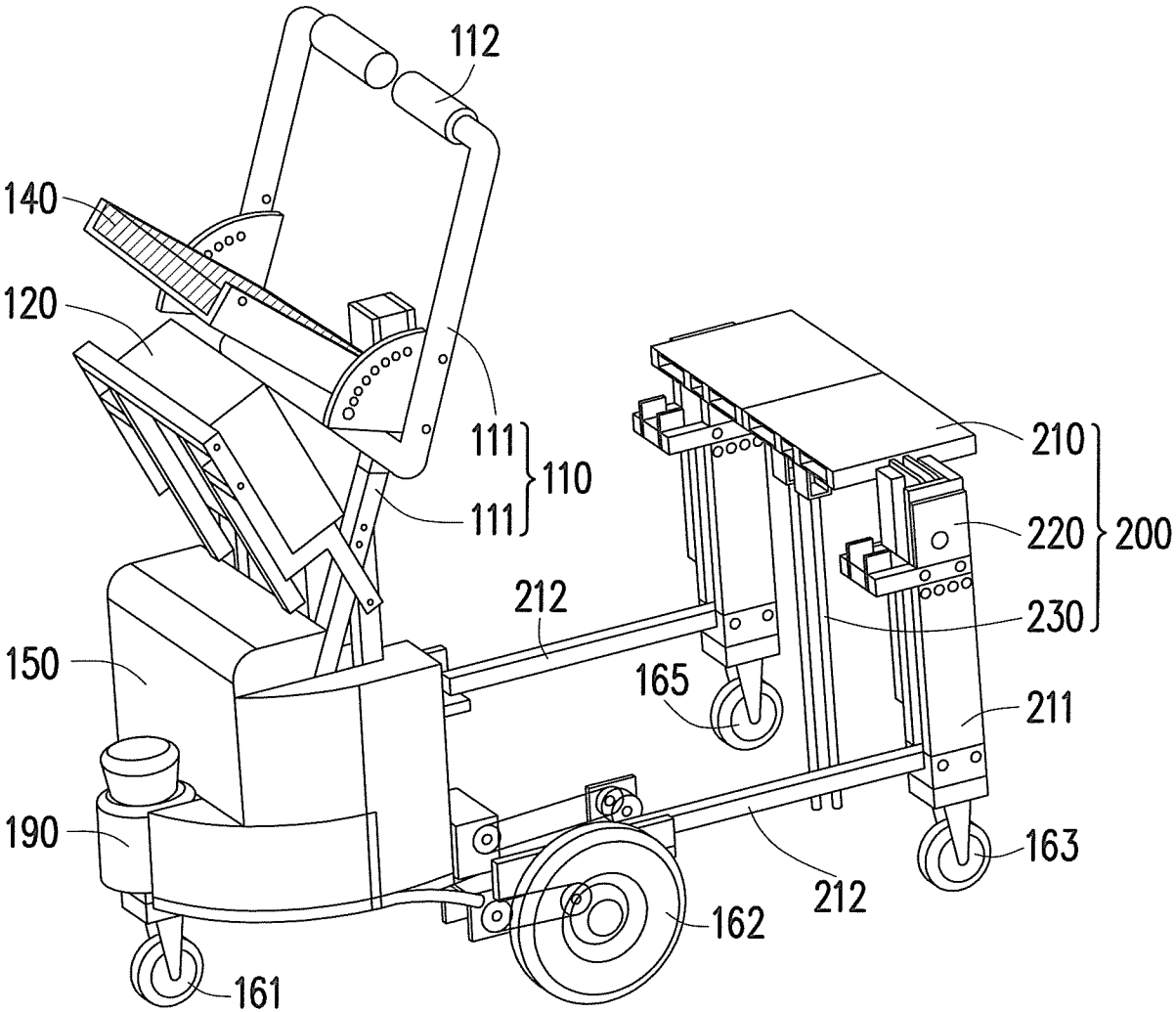

Each structure and an adjustment operation thereof in the movable seat member 200 are described in detail below. The movable seat member 200 includes two seat structures opposite to each other, and each of the seat structures includes a seat portion 210, a movable shaft mechanism 220 and a support portion 230. The seat portion 210 has a seat surface S1 and a second surface S2 opposite to the seat surface S1. The movable shaft mechanism 220 is connected to the seat portion 210 to enable the seat portion 210 to be unfolded or folded with respect to the body 110. The movable shaft mechanism 220 may further include an uplift structure, so that the user 105 may adjust a height of the seat portion 210 based on demands. The support portion 230 is connected to the second surface S2 of the seat portion 210. An unfold operation of the seat portion 210 may refer to the drawings of FIG. 5 to FIG. 8. The user 105 or the accompanying personnel may rotate the seat portion 210 in right angle (90 degrees) by using the movable shaft mechanism 220 (as shown in FIG. 6), and place the seat portion 210 down in a direction parallel to the ground (as shown in FIG. 7). When the seat portion 210 is unfolded by the movable shaft mechanism 220, the support portion 230 may be bent to contact the ground for supporting the seat portion 230 (as shown in FIG. 8), so as to complete the unfold operation of the seat portion 210. In the present embodiment, the support portions 230 are respectively two pillar support members connected by a movable spindle. The two pillar support members may be bent in a manner of right angle, and the seat portion 210 and the pillar support member are also connected by the movable spindle. On the other hand, a folding operation of the seat portion 210 may be completed according to the breakdown views in a sequence from FIG. 8 to FIG. 5.

The control system 140 of the present embodiment may be a computer device having a general or customized operating system for realizing various functions described above. The control system 104 further includes a display device configured to provide a multimedia human computer interface, so that the user or the accompanying personnel may control the rehabilitation device 100 through the multimedia human computer interface. This multimedia human computer interface may also provide diverse programs to additionally offer entertainment features.

Figure 9:
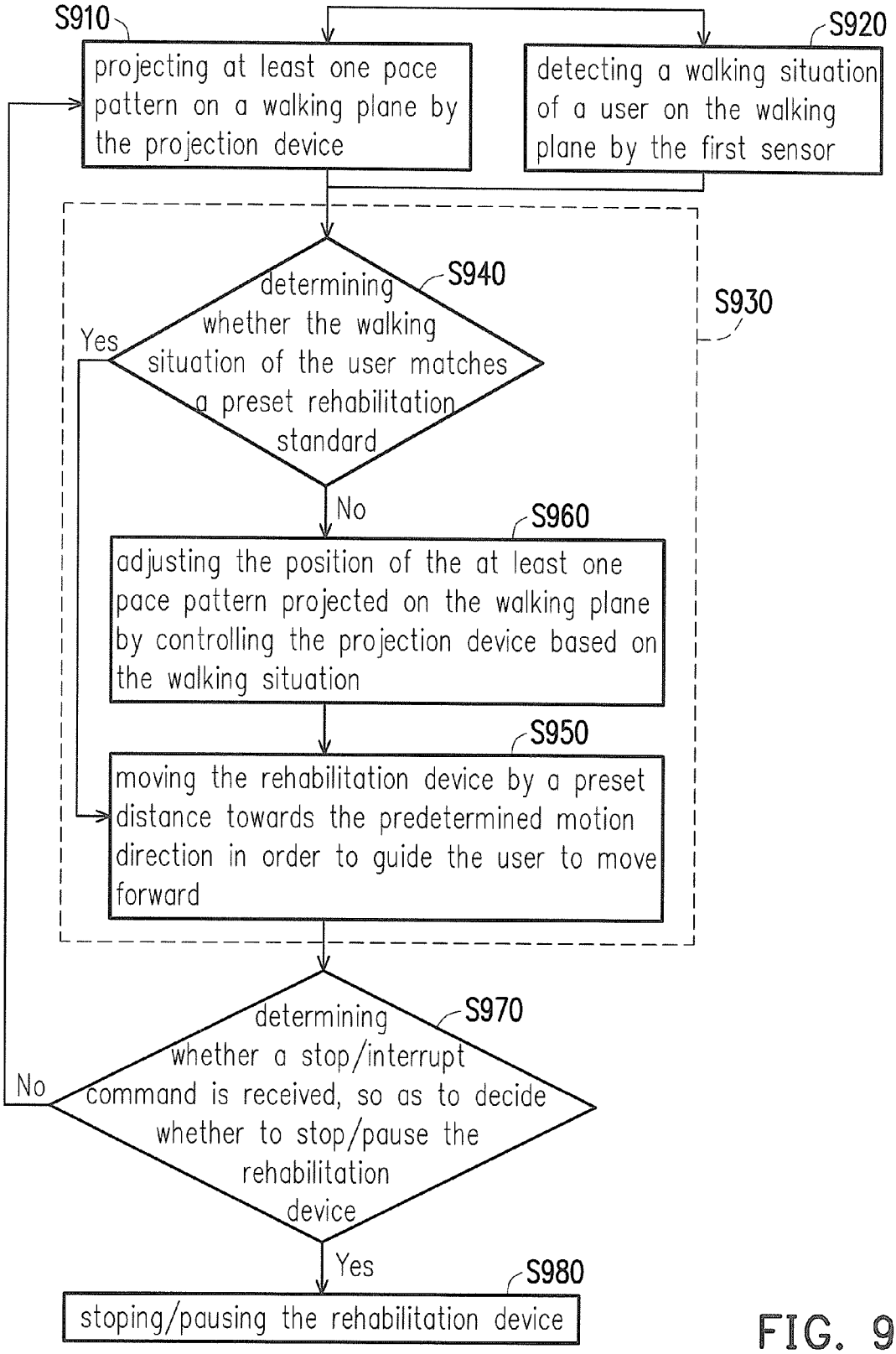
FIG. 9 is a flowchart illustrating a control method of the rehabilitation device according to the embodiment of the invention.

From another aspect, the embodiment of the invention further provides a control method of the rehabilitation device 100. FIG. 9 is a flowchart illustrating a control method of the rehabilitation device 100 according to the embodiment of the invention. Referring to FIG. 1 and FIG. 9 together, in step S910, the control system 140 of the rehabilitation device 100 controls the projection device 120 to project one or more of the pace patterns 180 on the walking plane 170. Meanwhile, in step S920, the control system 140 controls the first sensor 130 to detect the walking situation of the user 105 on the walking plane 170. Step S910 and step S920 may be executed simultaneously, or may be executed with a precedence based on demands of persons who applying the present embodiment. In step S930, the control system 140 controls the moving module 160 to adjust the distance between the rehabilitation device 100 and the user 105 based on the walking situation obtained in step S920, and controls the projection device 120 to adjust the position of the pace pattern 180 on the walking plane 170, so as to adjust the distance between the pace pattern 180 and the user 105 for the user 105 to achieve the rehabilitation effects.

More specifically, step S930 may be divided into steps S940 to S960. In step S940, the control system 140 determines whether the walking situation of the user 105 matches the preset rehabilitation standard. When the walking situation matches the preset rehabilitation standard (i.e., when a determination result of step S940 is yes), proceeding to step S950 in which the control system 140 moves the rehabilitation device 100 by the preset distance towards the predetermined motion direction in order to guide the user 105 to move forward. In other words, step S950 allows the user 105 to move forward together with rehabilitation device 100 in every step of the way. In contrast, when the walking situation does not match the preset rehabilitation standard (i.e., when the determination result of step S940 is no), proceeding to step S960 in which the control system 140 controls the projection device 120 to adjust the position of the pace pattern 180 projected on the walking plane 170 based on the walking situation of the user 105, so that the distance between the pace pattern 180 and the user 105 can properly match the walking situation of the user 105. Thereafter, proceeding to step S950 from step S960, so that the user 105 may continue to move forward together with rehabilitation device 100 in every step of the way. In step S970, the control system 140 determines whether a stop/interrupt command is received, so as to decide whether to stop/interrupt the rehabilitation process of the rehabilitation device 100. The stop/interrupt command may be generated by the gripping member 112 when the physiological value of the user exceeds the preset physiological value range, or generated by the remote control commands from the external device. If step S970 is yes, proceeding to step S980 to stop/pause the rehabilitation device 100. If step S970 is no, proceeding back to step S910 to continue executing the rehabilitation process. Related description regarding the present embodiment of the invention has been disclosed above, which is not repeated hereinafter.

In summary, the rehabilitation device according to the embodiment of the invention controls the projection device to project the pace pattern on the moving direction of the user and detects the walking situation of the user in order to adaptively adjust the distance between the pace pattern and the user or adjust the distance between the rehabilitation device and the user. Accordingly, the rehabilitation device is capable of providing additional visual guide through projection of the pace patterns to assist the user in the walking exercises, so that the user may achieve the expected effects during the rehabilitation process. On the other hand, the rehabilitation device is capable of knowing whether the user is exhausted according to the physiological sensing unit in the handles gripped by the user, so as to prevent the user from not being able to stand due to exhaustion. The pressure sensing unit in the handles allows the user to change the moving direction of the rehabilitation device. The movable seat mechanism is further disposed on the rear of the rehabilitation device for the user to sit down on the movable seat mechanism and towards the front of the rehabilitation device to rest moderately. The movable seat mechanism can be easily folded or unfolded by the user.

Although the present invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A rehabilitation device, comprising:

a body, having a moving module;

a projection device, disposed on the body, and configured to project at least one pace pattern on a walking plane;

a first sensor, disposed on the body and towards an opposite direction of a predetermined motion direction of the body, and configured to detect a walking situation of a user on the walking plane; and a control system, disposed on the body, and connected to the projection device and the first sensor, wherein based on the walking situation detected by the first sensor, the control system adjusts a distance between the rehabilitation device and the user by controlling the moving module and adjusts a position of the at least one pace pattern on the walking plane by controlling the projection device.

2. The rehabilitation device of claim 1, wherein the first sensor is a first image capturing device, and the control system receives an image captured on the walking plane by the first image capturing device in order to obtain the walking situation of the user.

3. The rehabilitation device of claim 1, wherein the walking situation of the user comprises one of a spacing distance between the user and the rehabilitation device, a stride length per step of the user, a gait speed of the user, two foot positions of the user, a foot reaction time of the user to the at least one pace pattern, or a combination thereof.

4. The rehabilitation device of claim 1, wherein when the control system determines that the walking situation of the user matches a preset rehabilitation standard, the control system controls the moving module to move the rehabilitation device by a preset distance towards the predetermined motion direction in order to guide the user to move forward.

5. The rehabilitation device of claim 4, wherein when the control system determines that the walking situation of the user does not match the preset rehabilitation standard, the control system controls the projection device based on the walking situation to adjust the position of the at least one pace pattern projected on the walking plane for matching to the walking situation of the user.

6. The rehabilitation device of claim 1, wherein the body further comprises:

a movable seat member, disposed on brackets above rear wheels at two sides of the body.

7. The rehabilitation device of claim 6, wherein the movable seat member comprises two seat structures opposite to each other, and each of the seat structures comprises:

a seat portion, having a seat surface and a second surface opposite to the seat surface;

a movable shaft mechanism, connected to the seat portion to enable the seat portion to be unfolded or folded with respect to the body; and a support portion, connected to the second surface of the seat portion, and configured to support the seat portion by bending the support portion to contact the ground when the seat portion is unfolded by the movable shaft mechanism.

8. The rehabilitation device of claim 1, wherein the body further comprises a gripping member disposed on the body, wherein the gripping member comprises:

a pressure sensing unit, connected to the control system to sense a gripping degree of a hand portion of the user with respect to the gripping member; and a physiological sensing unit, connected to the control system to sense a physiological value of the user.

9. The rehabilitation device of claim 8, wherein when the control system detects that the physiological value of the user exceeds a preset physiological value range by the physiological sensing unit, the control system controls the moving module to stop moving the rehabilitation device.

10. The rehabilitation device of claim 8, wherein the control system changes a moving direction of the rehabilitation device when the pressure sensing unit detects that the gripping degree with respect to a left handle or a right handle of the gripping member is greater than a preset pressure value.

11. The rehabilitation device of claim 1, further comprising:

a second sensor, disposed on the body and towards the predetermined motion direction of the body, and connected to the control system, wherein the second sensor senses whether an object exists in the predetermined motion direction and determines a distance between the object and the rehabilitation device, so as to generate an object sensing signal and provide the object sensing signal to the control system.

12. The rehabilitation device of claim 11, wherein the second sensor is an environment map sensor configured to detect obstacles near the rehabilitation device and execute an indoor positioning.

13. The rehabilitation device of claim 1, further comprising:

a display device, disposed on the body, and configured to provide a multimedia human computer interface to control the rehabilitation device.

* * * * *